US009630314B2

(12) United States Patent
Ou

(10) Patent No.: US 9,630,314 B2
(45) Date of Patent: Apr. 25, 2017

(54) SOCKET HOLDER

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 40 days.

(21) Appl. No.: 14/725,536

(22) Filed: May 29, 2015

(65) Prior Publication Data

US 2016/0346913 A1 Dec. 1, 2016

(51) Int. Cl.
*B25H 3/00* (2006.01)
*B65D 73/00* (2006.01)

(52) U.S. Cl.
CPC ..... *B25H 3/003* (2013.01); *B65D 73/0035* (2013.01)

(58) Field of Classification Search
CPC ..... A47F 7/0028; B25H 3/003; B25H 3/006
USPC ..... 206/379, 486, 1.5, 349, 372–378; 211/70.6; 248/314, 551
See application file for complete search history.

(56) References Cited

U.S. PATENT DOCUMENTS 5,328,029 A * 7/1994 Chow ..... B25H 3/003 206/376
6,098,799 A * 8/2000 Lee ..... B25H 3/003 206/350
6,273,255 B1 * 8/2001 Rosler ..... B65D 73/0064 206/378
6,695,142 B2 * 2/2004 Chen ..... B25H 3/003 206/378
8,205,758 B2 * 6/2012 Shih ..... A47F 7/0028 206/378
2002/0074255 A1 * 6/2002 Lee ..... B25H 3/003 206/378
2005/0000836 A1 * 1/2005 Hsien ..... B25H 3/003 206/349
2008/0128370 A1 * 6/2008 Shih ..... B25H 3/003 211/70.6
2010/0170817 A1 * 7/2010 Wu ..... B25H 3/04 206/378
2015/0165616 A1 * 6/2015 Chern ..... B25B 13/06 206/349
2015/0183573 A1 * 7/2015 Chao-Ming ..... B65D 85/02 206/378

FOREIGN PATENT DOCUMENTS

TW M320343 10/2007
TW M376405 3/2010

* cited by examiner

*Primary Examiner* — Chun Cheung
(74) *Attorney, Agent, or Firm* — Muncy, Geissler, Olds & Lowe, P.C.

(57) ABSTRACT

A socket holder is provided, including a main body having at least one receiving slot for a socket to be arranged therein and at least one restriction portion. Each receiving slot has a first end portion, a second end portion opposite to the first end portion and a slot opening. Each restriction portion has a first arm portion extending from the first end portion substantially toward the second arm portion and a second arm portion transverse to the first arm portion and extending toward a wall of the receiving slot. Wherein, when the socket is arranged in the receiving slot, the first and second arm portions protrude into a sleeve opening of an end of the socket to restrictedly abut against an inner wall thereof, and the second end portion restrains the other end of the socket from swinging toward the slot opening.

9 Claims, 5 Drawing Sheets

SOCKET HOLDER

BACKGROUND OF THE INVENTION

Field of the Invention

The present invention relates to a socket holder.

Description of the Prior Art

Usually, a seller of sockets hangs the sockets on a socket holder to prevent the sockets from being mixed in a container; hence, a buyer can find and purchase the socket s/he wants quickly. In a conventional socket holder, an extension portion is inserted into a sleeve opening, and two protruding portions which are semi-spheral opposite to each other are disposed on the extension portion to be engaged with a recessive hole on an inner wall of the sleeve opening of the socket so as to connect the socket with the socket holder and hang the socket. This type of conventional sockets are disclosed in TWM 376405 and TWM320343.

However, in this type of prior art, the socket holder connects with the socket only via the protruding portion, so the protruding portion is easily abraded by stress. Therefore, the protruding portion is usually thrown away after the socket holder is purchased. In addition, the conventional socket holder does not include a portion for covering the socket; therefore, the socket collides with other objects easily and is abraded easily.

The present invention has arisen to mitigate and/or obviate the afore-described disadvantages.

SUMMARY OF THE INVENTION

The major object of the present invention is to provide a socket holder which is provided for, in addition to hanging sockets, preventing the sockets from being taken away quickly in a store. Furthermore, the socket holder can maintain an entirety of the sockets effectively and be used to store the sockets repeatedly.

To achieve the above and other objects, a socket holder of the present invention is provided, including a main body. The main body has at least one receiving slot for a socket to be arranged therein and at least one restriction portion. Each said receiving slot has a first end portion, a second end portion opposite to the first end portion and a slot opening. Each said restriction portion has a first arm portion which extends from the first end portion substantially toward the second end portion and a second arm portion which is transverse to the first arm portion and extends toward a wall of the receiving slot. Wherein, when the socket is arranged in one said receiving slot, the first and second arm portions protrude into a sleeve opening of an end of the socket to be restrictedly abut against an inner wall of the sleeve opening, and the second end portion restricts movement of the other end of the socket toward the slot opening.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
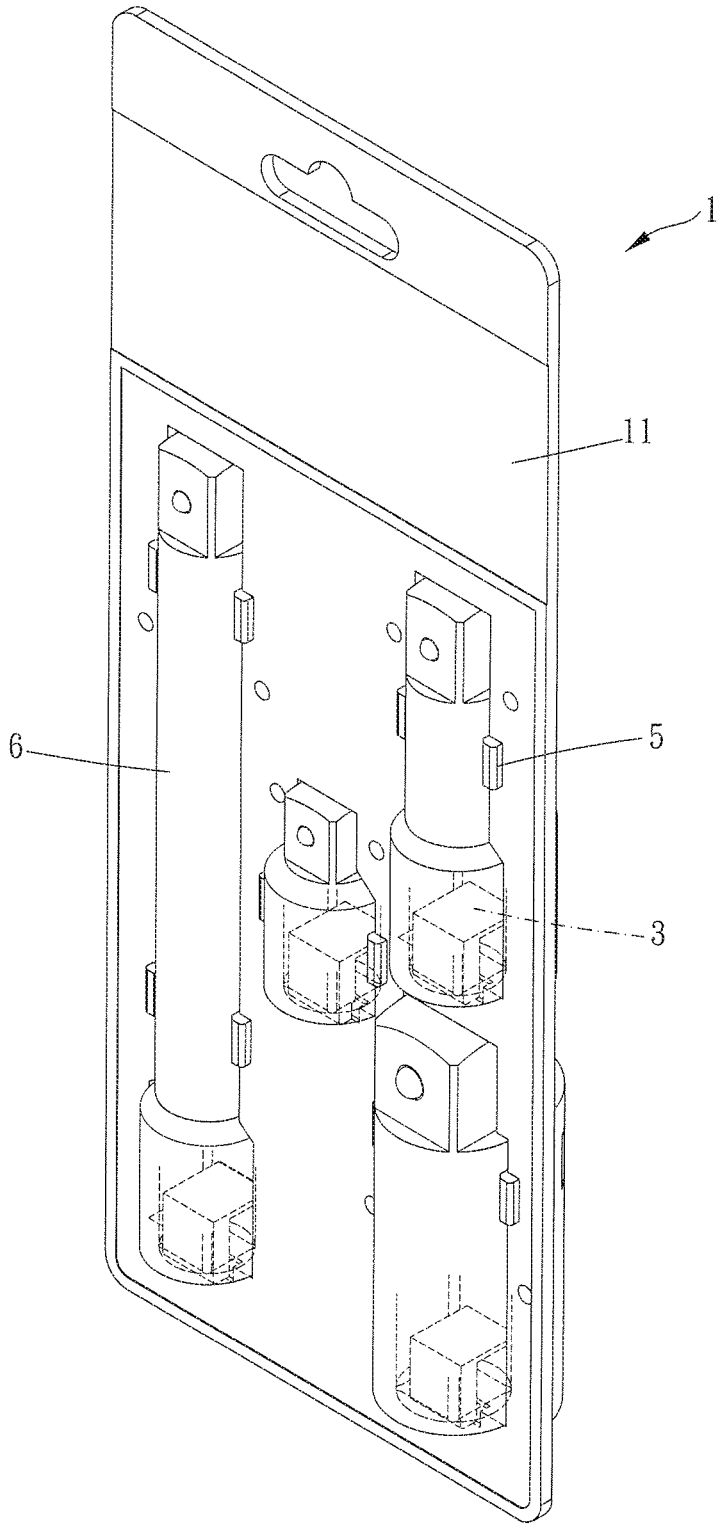
FIG. 1 is a drawing showing a preferred embodiment of the present invention in use.
Figure 2:
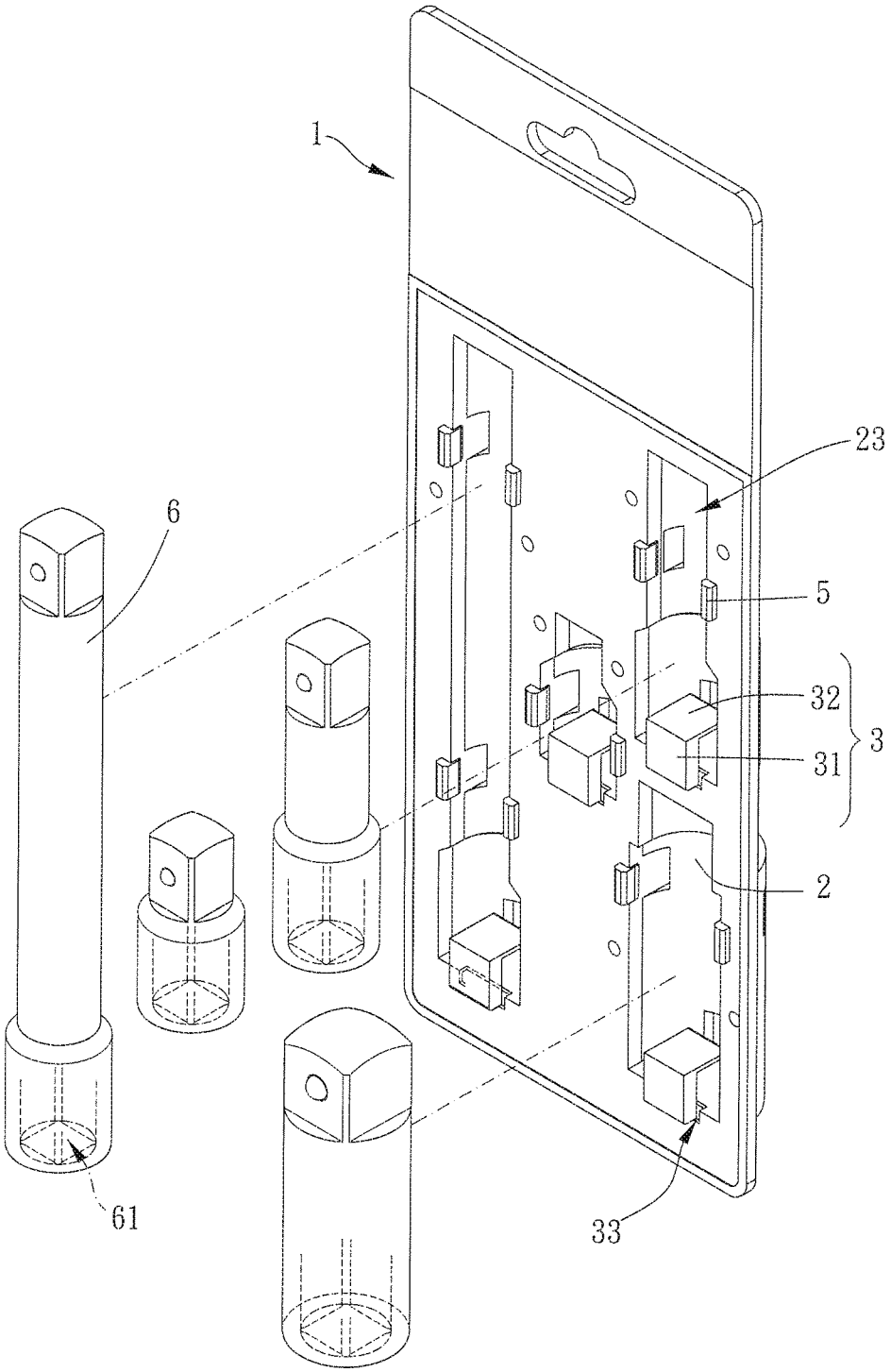
FIG. 2 is a perspective view of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 5 for a preferred embodiment of a socket holder 1 of the present invention. The socket holder 1 includes a main body 11.

The main body 11 has at least one receiving slot 2 for a socket 6 to be arranged therein and at least one restriction portion 3. Each said receiving slot 2 has a first end portion 21, a second end portion 22 opposite to the first end portion 21 and a slot opening 23. Each said restriction portion 3 has a first arm portion 31 which extends from the first end portion 21 substantially toward the second end portion 22, a second arm portion 32 which is transverse to the first arm portion 31 and extends toward a wall 24 of the receiving slot 2. When the socket 6 is arranged in the receiving slot 2, the first and second arm portions 31, 32 protrude into a sleeve opening 61 of an end of the socket 6 to be restrictedly abut against an inner wall 231 of the sleeve opening 61. The second end portion 22 restricts movement of the other end of the socket 6 toward the slot opening 23. Wherein, the receiving slot 2 can prevent the socket 6 from being struck directly and abraded easily and protect an entirety of the socket 6.

In this embodiment, the restriction portion 3 is substantially L-shaped. The first arm portion 31 is substantially parallel to the slot opening 23, and the second arm portion 32 is substantially perpendicular to the first arm portion 31. The first arm portion 31 is provided relatively above and at least partially protrusive beyond the receiving slot 2. When the socket 6 is arranged in the receiving slot 2, the inner wall 231 of the sleeve opening 61 abuts against the first arm portion 31 laterally and moves toward the first end portion 21, and a distal end of the second arm portion 32 is pushed by the inner wall 231 laterally; therefore, the second arm portion 32 moves toward the first end portion 21 and is bent, and a position of a distal end of the first arm portion 31 lowers so that the restriction portion 3 is protrudable into the sleeve opening 61. When the socket 6 stops moving, the first and second arm portions 31, 32 keep abutting against the inner wall 231 tightly due to counterforce. It is understandable that the second arm portion 32 is more flexible than the first arm portion 31, and the restriction portion 3 is protrudable into the sleeve opening 61 smoothly; therefore, the second arm portion 32 may be made of other materials. In this embodiment, the first and second arm portions 31, 32 are integrally formed, and a thickness of the second arm portion 32 is smaller than a half of a thickness of the first arm portion 31 so that the restriction portion 3 is protrudable into the sleeve opening 61 smoothly. In addition, to prevent the restriction portion 3 from being stuck during the process of protruding into the sleeve opening 61, a wall 24 of each said receiving slot 2 is preferably formed with a first through hole 51 opposite to the restriction portion 3, and the first through hole 51 is for providing a margin for an end of the socket 6 when the socket 6 is arranged therein.

It is to be noted that usually, one of the methods to take the socket 6 off from the socket holder 1 is that the socket 6 is moved toward the second end portion 22 to disengage the sleeve opening 61 with the restriction portion 3. However, the receiving slot 2 is usually tight fit with the socket 6, and even if there is a gap, a distance between the second end portion 22 and the socket 6 is much smaller than a length of the first arm portion 31; therefore, the socket 6 cannot be taken off The other method is that the socket 6 pivotally abuts the receiving slot 2 with the end having the sleeve opening 61 and the other end of the socket 6 swings toward the slot opening 23. However, the first and second arm portions 31, 32 respectively abut against the inner wall 231 from different directions so that the socket 6 cannot be taken off by swinging. Furthermore, a fulcrum of the socket 6 is a position where a distal end of the socket 6 abuts against the first arm portion 31, and the greatest distance between the pivoting position and the socket 6 is greater than a distance between the first and second end portions 21, 22; therefore, the second end portion 22 can restrict the other end of the socket 6 and restrain the socket 6 from being taken off.

Figure 3:
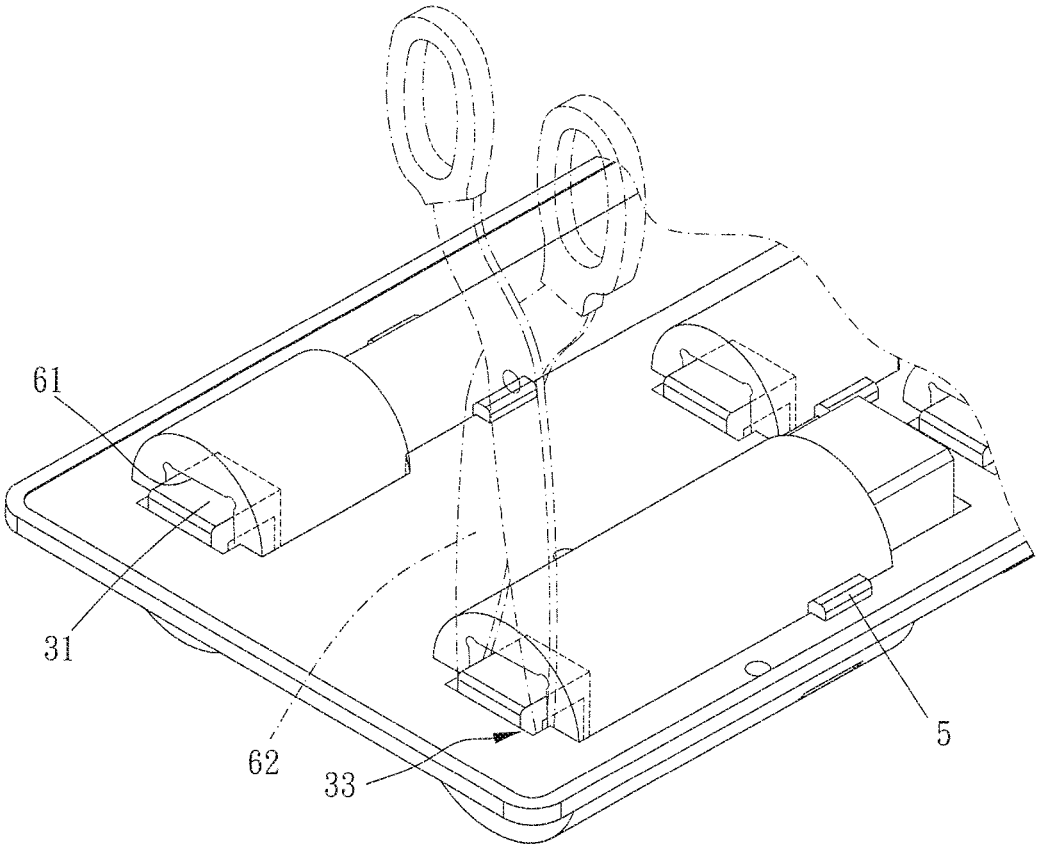
FIG. 3 is drawing showing detachment of a socket according to the preferred embodiment of the present invention.
Figure 4:
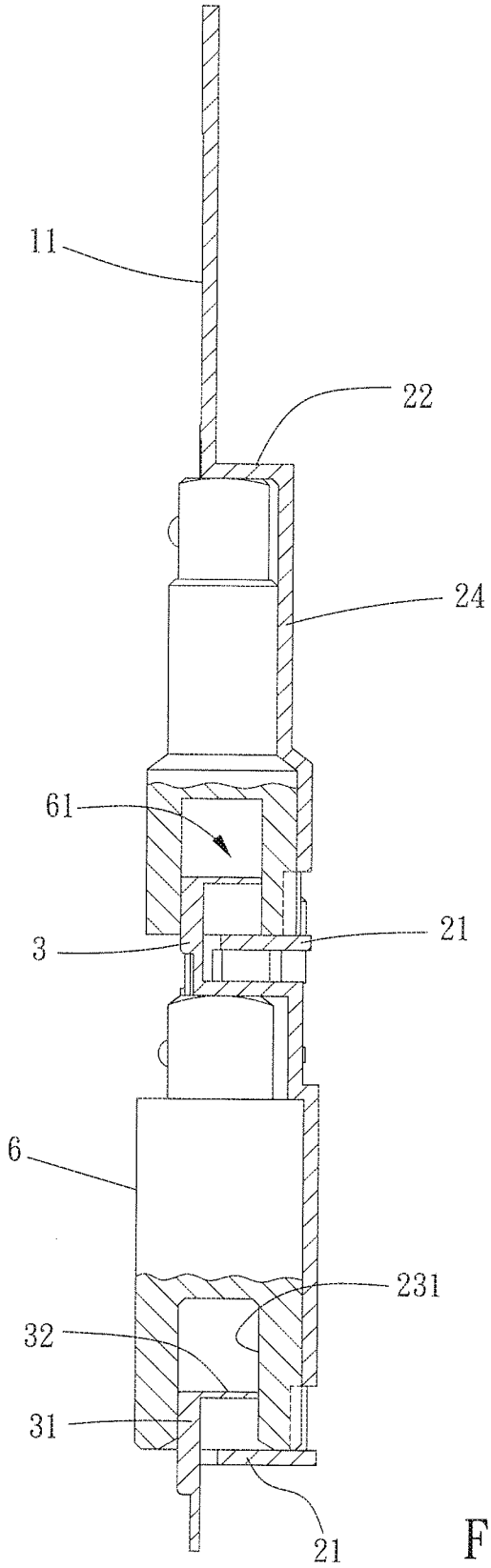
FIG. 4 is a partial cross-sectional side view of the preferred embodiment of the present invention.
Figure 5:
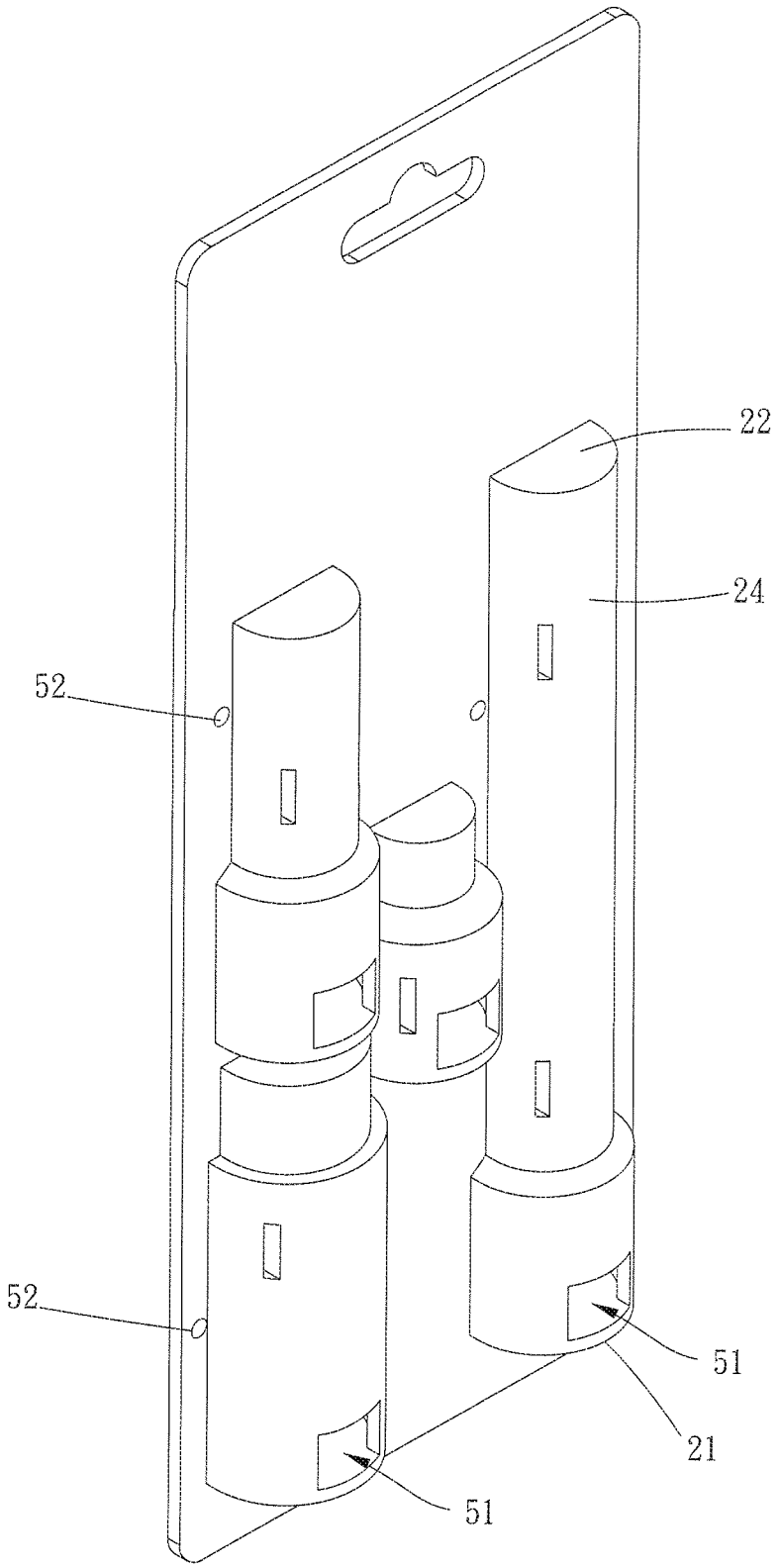
FIG. 5 is another perspective view of the preferred embodiment of the present invention.

Given the above, the socket 6 cannot be taken off by common methods. When a user wants to take the socket 6 off from the socket holder 1, s/he has to break the restriction portion 3. As shown in FIG. 3 of this embodiment, two recesses 33 are formed by two sides of the first arm portion 31 respectively, and each said recess 33 is for a cutter 62 to be inserted therein so that the user can cut the first arm portion 31 and take the socket 6 off from the socket holder 1. It is understandable that each said recess 33 may also be a through hole so that each said cutter 62 can break the first arm portion 31 from the other side (but not limited thereto). Wherein, since it needs a period of time and a cutting tool to break the first arm portion 31, the socket 6 can be prevented from being taken away easily when being sold in stores.

Each said receiving slot 2 is formed with at least one block portion 5 near the slot opening 23, and each block portion 5 is for the socket 6 to abut thereagainst when the socket 6 is arranged in the receiving slot 2. When the restriction portion 3 is out of the main body 11, the socket holder 1 still can receive and fix the socket 6 effectively to prevent the socket 6 from falling off Therefore, the socket holder 1 can be used repeatedly. When the socket 6 is hung, the socket 6 is far from a ground and may fall off due to shaking; therefore, the at least one block portion 5 is preferably formed near the second end portion 22. Furthermore, a second through hole 52 is formed by two sides of each receiving slot 2 respectively, and each said second through hole 52 is for a protruding portion of an additional outer shell body (not shown) to be disposed therethrough and fixed on the main body 11 to cover the socket 6 thoroughly. When each said block portion 5 is abraded, a strip-shaped object may be disposed through each said second through hole 52 and around the socket 6 to fix the socket 6.

Given the above, the socket holder of the present invention can fix the socket tightly via the restriction portion so as to prevent the socket from being taken off easily, and the receiving slot can protect the socket from abrasion.

In addition, when the restriction portion is removed, the block portion allows the user to use the socket holder to receive the socket continuously.

While we have shown and described various embodiments in accordance with the present invention, it should be clear to those skilled in the art that further embodiments may be made without departing from the scope of the present invention.

What is claimed is:

1. A socket holder, including:

a main body, having at least one receiving slot for a socket to be arranged therein and at least one restriction portion, each said receiving slot having a first end portion, a second end portion opposite to the first end portion and a slot opening, each said restriction portion having a first arm portion which extends from the first end portion substantially toward the second end portion and a second arm portion which is transverse to the first arm portion and extends toward a wall of the receiving slot;

wherein, when the socket is arranged in one said receiving slot, the first and second arm portions protrude into a sleeve opening of an end of the socket and restrictedly abut against an inner wall of the sleeve opening, and the second end portion restricts movement of the other end of the socket toward the slot opening;

wherein each said receiving slot is formed with at least one block portion near the slot opening, and each said block portion is for the socket to abut thereagainst when the socket is arranged in the receiving slot.

2. The socket holder of claim 1, wherein the second arm portion is more flexible than the first arm portion.

3. The socket holder of claim 1, wherein a thickness of the second arm portion is smaller than a half thickness of the first arm portion.

4. The socket holder of claim 1, wherein the restriction portion is substantially L-shaped, the first arm portion is substantially parallel to the slot opening, and the second arm portion is substantially perpendicular to the first arm portion.

5. The socket holder of claim 1, wherein two recesses are formed by two sides of the first arm portion respectively, and each said recess is for a cutter to be inserted therein.

6. The socket holder of claim 1, wherein the first arm portion is provided relatively above and at least partially protrusive beyond the receiving slot.

7. The socket holder of claim 1, wherein the at least one block portion is disposed near the second end portion.

8. The socket holder of claim 1, wherein the wall of each said receiving slot is formed with a first through hole opposite to the restriction portion, and the first through hole is for providing a margin for an end of the socket when the socket is arranged therein.

9. A socket holder, including:

a main body, having at least one receiving slot for a socket to be arranged therein and at least one restriction portion, each said receiving slot having a first end portion, a second end portion opposite to the first end portion and a slot opening, each said restriction portion having a first arm portion which extends from the first end portion substantially toward the second end portion and a second arm portion which is transverse to the first arm portion and extends toward a wall of the receiving slot;

wherein, when the socket is arranged in one said receiving slot, the first and second arm portions protrude into a sleeve opening of an end of the socket and restrictedly abut against an inner wall of the sleeve opening, and the second end portion restricts movement of the other end of the socket toward the slot opening;

wherein two second through holes are disposed on two sides of each said receiving slot respectively.

* * * * *